US012252757B2

(12) United States Patent
Matsumoto et al.

(10) Patent No.: US 12,252,757 B2
(45) Date of Patent: Mar. 18, 2025

(54) DRILL TOOL AND METHOD FOR PRODUCING SAME

(71) Applicant: Furukawa Rock Drill Co., Ltd., Tokyo (JP)

(72) Inventors: Yoshimi Matsumoto, Takasaki (JP); Genki Fusato, Takasaki (JP)

(73) Assignee: Furukawa Rock Drill Co., Ltd., Tokyo (JP)

( * ) Notice: Subject to any disclaimer, the term of this patent is extended or adjusted under 35 U.S.C. 154(b) by 756 days.

(21) Appl. No.: 17/424,801

(22) PCT Filed: Jan. 15, 2020

(86) PCT No.: PCT/JP2020/001031
§ 371 (c)(1),
(2) Date: Jul. 21, 2021

(87) PCT Pub. No.: WO2020/153185
PCT Pub. Date: Jul. 30, 2020

(65) Prior Publication Data

US 2022/0090222 A1 Mar. 24, 2022

(30) Foreign Application Priority Data

Jan. 25, 2019 (JP) ..... 2019-011523

(51) Int. Cl.

| | |
|---|---|
| ***C21D 9/22*** | (2006.01) |
| ***C21D 1/18*** | (2006.01) |
| ***C21D 1/58*** | (2006.01) |
| ***C22C 38/02*** | (2006.01) |
| ***C22C 38/04*** | (2006.01) |
| ***C22C 38/44*** | (2006.01) |
| ***C23C 18/16*** | (2006.01) |
| ***C23C 18/32*** | (2006.01) |
| ***E21B 17/042*** | (2006.01) |

(52) U.S. Cl.
CPC ..... *C21D 9/22* (2013.01); *C21D 1/18* (2013.01); *C21D 1/58* (2013.01); *C22C 38/02* (2013.01); *C22C 38/04* (2013.01); *C22C 38/44* (2013.01); *C23C 18/1637* (2013.01); *C23C 18/32* (2013.01); *E21B 17/042* (2013.01)

(58) Field of Classification Search
CPC ... C21D 9/22; C21D 1/18; C21D 1/58; C21D 2211/009; C21D 1/26; C21D 1/06; C21D 1/25; C21D 1/76; C21D 6/004; C21D 6/04; C22C 38/02; C22C 38/04; C22C 38/44; C23C 18/1637; C23C 18/32; C23C 18/1692; E21B 17/042; E21B 17/00
See application file for complete search history.

(56) References Cited

U.S. PATENT DOCUMENTS

| | | | | |
|---|---|---|---|---|
| 5,873,956 | A | 2/1999 | Tanaka et al. | |
| 2009/0013831 | A1 | 1/2009 | Linden | |
| 2012/0063857 | A1* | 3/2012 | Onozawa | B23B 51/00 408/229 |
| 2018/0209023 | A1 | 7/2018 | Wennberg et al. | |
| 2018/0209024 | A1 | 7/2018 | Wennberg et al. | |
| 2020/0149148 | A1 | 5/2020 | Ihara et al. | |

FOREIGN PATENT DOCUMENTS

| | | | | |
|---|---|---|---|---|
| CN | 104962712 | A | * | 10/2015 |
| CN | 107805776 | A | * | 3/2018 |
| JP | H09-287058 | A | | 11/1997 |
| JP | 2001-342788 | A | | 12/2001 |
| JP | 2005-240120 | A | | 9/2005 |
| JP | 2010-255099 | A | | 11/2010 |
| JP | 2015-190011 | A | | 11/2015 |
| JP | 2016-125133 | A | | 7/2016 |
| JP | 2018-527458 | A | | 9/2018 |
| WO | 2009/008798 | A1 | | 1/2009 |
| WO | 2018/101451 | A1 | | 6/2018 |

OTHER PUBLICATIONS

Office Action issued in corresponding CN Application No. 202080010833.X, issued Apr. 22, 2023, and its English translation, 21 pgs.
Office Action issued in corresponding CN Application No. 202080010833.X, issued Oct. 25, 2022, and its English translation, 18 pgs.
Office Action in corresponding CN Application No. 202080010833.X, issued Aug. 11, 2023, and its English translation, 15 pgs.
Transmittal of the English translation of the international preliminary report on patentability (Chapter I), and the Engish translation, mailed Aug. 5, 2021, 6 pgs.

* cited by examiner

*Primary Examiner* — Anthony M Liang
*Assistant Examiner* — Danny N Kang
(74) *Attorney, Agent, or Firm* — Young Basile Hanlon & MacFarlane, P.C.

(57) ABSTRACT

A drill tool capable of coping with a rock drill having high output power and a method for producing the drill tool are described. The drill tool is produced by employing, as a drill tool material, an alloy steel composed of the following chemical components: 0.22 to 0.26 wt % of C, 0.15 to 0.35 wt % of Si, 0.55 to 0.80 wt % of Mn, 2.60 to 3.00 wt % of Ni, 1.00 to 1.50 wt % of Cr, 0.20 to 0.30 wt % of Mo, and Fe and inevitable impurities as the balance. Heat treatment with quenching is performed after carburizing performed by means of oil cooling with cold oil and a tempering temperature set at 400 to 440° C.

4 Claims, 8 Drawing Sheets

DRILL TOOL AND METHOD FOR PRODUCING SAME

TECHNICAL FIELD

The present invention relates to a drill tool used for a rock drill or the like mounted on a crawler drill.

BACKGROUND

A crawler drill has a guide shell mounted to the tip of a boom disposed to a traveling carriage. A carriage, which advances and retracts by drive force of a feed mechanism, is disposed on the guide shell, and a rock drill is mounted on the upper surface of the carriage.

In an example illustrated in FIG. 12, a shank rod 150 is mounted to a rock drill 110 of this type, a rod 170 is screwed to the tip of the shank rod 150 via a sleeve 160, and a not-illustrated bit is screwed to the tip of the rod 170. Hereinafter, the shank rod, the sleeve, and the rod are also collectively referred to as "drill tools" DTp.

The rock drill 110 includes a known hammering mechanism and rotation mechanism. The rotation mechanism includes the shank rod 150, a chuck 35, a chuck driver 34, a driving gear 33, and a motor 32, as illustrated in FIG. 12. The rotation mechanism transmits rotational driving force of the motor 32 to the driving gear 33, the chuck driver 34, the chuck 35, and the shank rod 150, and thereby makes the shank rod 150 rotate.

The hammering mechanism includes a hammering piston 21, which is disposed in a cylinder 20 in an advanceable and retractable manner, and a not-illustrated switching valve, and the hammering piston 21 strikes a rear end surface 55 of the shank rod 150. The shank rod 150, by being struck by the hammering piston 21, transmits hammering energy to the rod 170 and the bit via the sleeve 160 and, in conjunction therewith, transmits a rotational driving force of the rotation mechanism to the rod 170 and the bit as described above, and thereby crushes bedrock.

Among the members constituting the rock drill 110, for example, the hammering piston 21 and the shank rod 150 are required to have high surface hardness because the hammering piston 21 and the shank rod 150 collide with each other. The hammering piston 21 is in sliding contact with the inner diameter surface of the cylinder 20, and the shank rod 150 is in sliding contact with the inner diameter surface of a front bush 43 and the inner diameter surfaces of seals 42 of a swivel 41.

As such, the hammering piston 21 and the shank rod 150 are respectively required to also have high wear resistance in conjunction with the high surface hardness. Therefore, as a material of the hammering piston 21 and the shank rod 150, alloy steel, known as nickel-chromium-molybdenum steel, is employed, and heat treatment by carburizing-quenching is performed on the nickel-chromium-molybdenum steel. Further, rotational torque also acts on the shank rod 150, as described above. As such, the hammering piston 21 and the shank rod 150 are required to have high toughness in addition to surface hardness and wear resistance.

Thus, a technology in which, in the conventional rock drill 110, alloy steel composed of the following chemical components: 2.5 to 3.5 wt % of Ni, 0.3 to 1.8 wt % of Cr, 0.2 to 0.7 wt % of Mo, 0.3 to 1.2 wt % of Mn, 0.1 to 0.27 wt % of C, and Fe and inevitable impurities as the balance is used for the drill tools DTp, such as the shank rod 150, the sleeve 160, and the rod 170. A surface-hardened layer in which hardness decreases from a surface layer portion toward a central portion is formed by performing surface treatment on the alloy steel under a condition illustrated in FIG. 10 has been proposed (See Patent Publication JP 2001-342788 A).

BRIEF SUMMARY

In recent years, rock drills have been provided with high output power, and there have occurred cases where drill tools DTp as described above are insufficient in strength.

In other words, while the front bush 43 and a centralizer (not illustrated) as bearing members are disposed to the drill tools DTp of the above-described rock drill 110 as a rotational deflection preventing mechanism, wear of the bearing members also tends to progress rapidly due to influence of the rock drill 10 having been provided with high output power.

When wear of the bearing members has progressed, there is a possibility that bending stress acts on the drill tools DTp due to thrust force of the feed mechanism. Stress concentrates on threaded portions 53 of the drill tools DTp and the drill tools DTp are broken.

Accordingly, the present invention has been made in view of the problem as described above, a problem to be solved by the present invention is to provide a production method for a drill tool and a drill tool that are capable of coping with a rock drill provided with high output power.

In order to achieve the object mentioned above, according to an aspect of the present invention, there is provided a production method for a drill tool, the production method being a method for producing a drill tool used for a rock drill, wherein the drill tool is produced by employing, as a material of the drill tool, alloy steel composed of following chemical components: 0.22 to 0.26 wt % of C, 0.15 to 0.35 wt % of Si, 0.55 to 0.80 wt % of Mn, 2.60 to 3.00 wt % of Ni, 1.00 to 1.50 wt % of Cr, 0.20 to 0.30 wt % of Mo, and Fe and inevitable impurities as the balance and, when carburizing-quenching and tempering are performed on the material as heat treatment, performing quenching after carburizing by means of oil cooling with cold oil and setting a tempering temperature at 400 to 440° C.

According to the production method for the drill tool according to the one aspect of the present invention, the internal structure of the produced drill tool becomes troostite and bending rigidity thereof is improved. Therefore, when the drill tool produced in accordance with this method is used for a rock drill provided with high output power, damage to the drill tool is prevented or suppressed even when wear of a bearing member has progressed and bending stress acts on the drill tool.

Further, in order to achieve the object mentioned above, according to an aspect of the present invention, there is provided a drill tool, wherein the drill tool is made of alloy steel, the constituent materials of which are composed of following chemical components: 0.22 to 0.26 wt % of C, 0.15 to 0.35 wt % of Si, 0.55 to 0.80 wt % of Mn, 2.60 to 3.00 wt % of Ni, 1.00 to 1.50 wt % of Cr, 0.20 to 0.30 wt % of Mo, and Fe and inevitable impurities as the balance. A structural state of the drill tool is troostite, and the surface hardness and core hardness of the drill tool are 47 to 50 Hardness Rockwell C (HRC) and 41 to 43 HRC, respectively. In a bending test (in accordance with Japanese Industrial Standards (JIS) Z2248) on a $\phi$40 mm×480 mm test piece, the drill tool, although bent 28 to 29.7 mm under a load of 155 kN, is not broken.

Because the internal structure of the drill tool according to an aspect of the present invention is troostite, bending rigidity is improved. Therefore, when the drill tool is used for a rock drill provided with high output power, damage to the drill tool is prevented or suppressed even when wear of a bearing member has progressed and bending stress acts on the drill tool.

Further, in order to achieve the object mentioned above, according to an aspect of the present invention, there is provided a drill tool, wherein a rod constituting the drill tool has a hollow cylindrical tube portion and a male threaded portion and a female threaded portion joined to both ends of the tube portion. With respect to only the male threaded portion and the female threaded portion, the rod is made of a material that is alloy steel, the constituent materials of which are composed of following chemical components: 0.22 to 0.26 wt % of C, 0.15 to 0.35 wt % of Si, 0.55 to 0.80 wt % of Mn, 2.60 to 3.00 wt % of Ni, 1.00 to 1.50 wt % of Cr, 0.20 to 0.30 wt % of Mo, and Fe and inevitable impurities as the balance, the structural state of which is troostite, and the surface hardness and core hardness of which are 47 to 50 HRC and 41 to 43 HRC, respectively. In a bending test (in accordance with JIS Z2248) on a ϕ40 mm×480 mm test piece, although bent 28 to 29.7 mm under a load of 155 kN, is not broken.

In some implementations, the drill tool is produced by subjecting the material to a heat treatment step that includes a carburizing-quenching step and a tempering step, carburizing-quenching step is performed by means of oil cooling with cold oil after carburizing, a temperature of the cold oil is set at 60° C. to 80° C., and a tempering temperature of the tempering step is set at 400° C. to 440° C.

In some implementations, sub-zero treatment is performed between the carburizing-quenching and the tempering.

In some implementations, electroless nickel plating treatment is performed after the tempering and, subsequently, heating is performed at a temperature equal to or less than the tempering temperature.

According to the drill tool according to the another aspect of the present invention, the rod constituting the drill tool is configured to be a drill tube that has a hollow cylindrical tube portion and, with respect to only a male threaded portion and a female threaded portion at both ends of the drill tool, is produced in accordance with the production method for the drill tool according to any one of the aspects of the present invention.

Because this configuration causes the internal structure to be troostite with respect to only the threaded portions at both ends, bending rigidity is improved. Therefore, when the drill tool using the rod (drill tube) is used for a rock drill provided with high output power, damage to the drill tool is prevented or suppressed even when wear of a bearing member has progressed and bending stress acts on the drill tool.

The present invention enables a drill tool capable of coping with a rock drill provided with high output power and a method for producing the drill tool to be provided.

BRIEF DESCRIPTION OF THE DRAWINGS

FIGS. 6A and 6B are photographs of a shank rod on which electroless nickel plating treatment is performed, wherein FIG. 6A is a photograph before a durability test and FIG. 6B is a photograph after the durability test.

DETAILED DESCRIPTION

A drill tool of a rock drill that is one embodiment of the present invention will be described below with reference to the drawings as appropriate. Note that the drawings are schematic. Therefore, it should be noted that relations between thicknesses and planar dimensions, ratios, and the like are different from actual ones and portions having different dimensional relationships and ratios from one another among the drawings are included.

In addition, the following embodiment indicates devices and methods to embody the technical idea of the present invention by way of example, and the technical idea of the present invention does not limit the materials, shapes, structures, arrangements, and the like of the constituent components to those described below. Note that, in the following embodiment and examples, description will be made with the same signs assigned to similar or corresponding constituent components to those of the above-described conventional rock drill.

Figure 1:
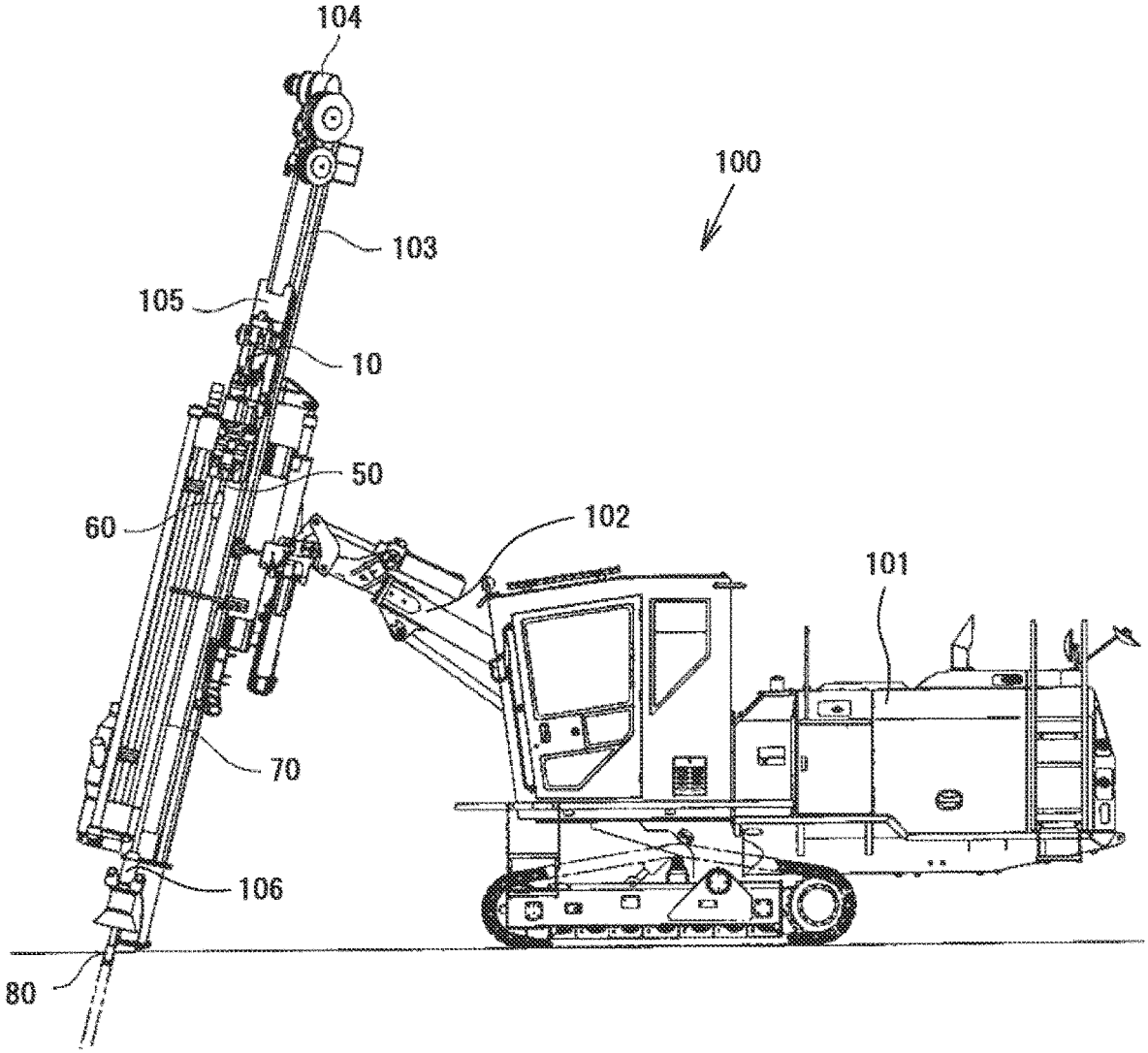
FIG. 1 is a schematic overall view illustrative of one embodiment of a crawler drill that is equipped with a rock drill using a drill tool according to one aspect of the present invention.

As illustrated in FIG. 1, a crawler drill 100 of the present embodiment has a guide shell 103 mounted at the tip of a boom 102 disposed to a traveling carriage 101, a carriage 105, which advances and retracts by drive force of a feed mechanism 104, disposed to the guide shell 103, and a rock drill 10 mounted on the upper surface of the carriage 105.

A shank rod 50 is mounted to the rock drill 10, a rod 70 is screwed to the tip of the shank rod 50 via a sleeve 60, and a bit 80 is screwed to the tip of the rod 70. In the present embodiment, the shank rod 50, the sleeve 60, and the rod 70 correspond to a drill tool described above. Hereinafter, in the description of the present application, the shank rod 50, the sleeve 60, and the rod 70 are also collectively referred to as drill tools DT.

Figure 2:
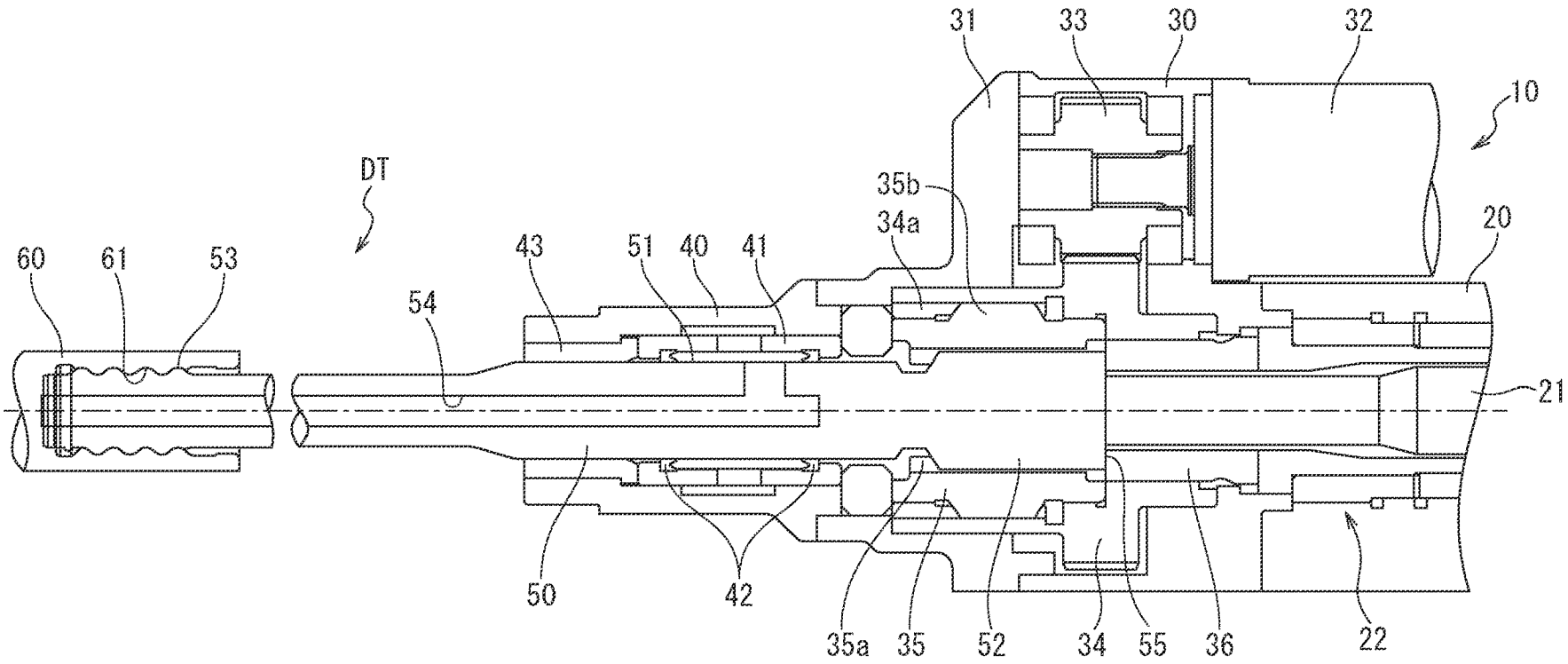
FIG. 2 is a schematic cross-sectional view illustrative of an internal structure of the rock drill illustrated in FIG. 1.

The rock drill 10 includes a known hammering mechanism and rotation mechanism. As illustrated in FIG. 2, the hammering mechanism includes a hammering piston 21, which is disposed in a cylinder 20 in an advanceable and retractable manner, and a not-illustrated switching valve. The hammering mechanism is configured such that the hammering piston 21 strikes a rear end surface 55 of the shank rod 50, which will be described later. The cylinder 20 includes a known damper mechanism 22 configured to press the drill tools DT against an object to be crushed while buffering repulsion that the drill tools DT receive from the object to be crushed.

The rotation mechanism includes a housing that has a front head 30 and a front cover 31 disposed in front of the front head 30. A front cap 40 is mounted ahead of the front cover 31, and a motor 32 is mounted in the rear of the front head 30. Inside the front head 30, a driving gear 33, which is connected to the output shaft of the motor 32, is supported in a freely rotatable manner.

In the housing of the rotation mechanism, the shank rod 50 is disposed coaxially with the hammering piston 21. A chuck 35 and a chuck driver 34 are disposed coaxially with the shank rod 50. The shank rod 50 is a rod-shaped member that has a sliding portion 51 formed at a middle portion, an outer-diameter square spline 52 formed at the rear end, and a threaded portion 53 formed at the front end. A water hole 54 through which flushing fluid flows is disposed at the central axis.

Between the rear end surface 55 of the shank rod 50 and the damper mechanism 22, a chuck driver bush 36 is disposed. The chuck driver 34 has an inner-diameter square spline 34*a* formed on the inner diameter surface thereof and a gear portion formed on the outer diameter surface thereof. The chuck 35 has an inner-diameter square spline 35*a* formed on the inner diameter surface thereof and an outer-diameter square spline 35*b* formed on the outer diameter surface thereof.

The outer-diameter square spline 52 of the shank rod 50 is fitted with the inner-diameter square spline 35*a* of the chuck 35, and the outer-diameter square spline 35*b* of the chuck 35 is fitted with the inner-diameter square spline 34*a* of the chuck driver 34. Rotational driving force of the motor 32 is transmitted to the shank rod 50 via the driving gear 33, the chuck driver 34, and the chuck 35.

In the front cap 40, a swivel 41 is disposed in a rotatable manner, and, on the inner diameter surface of the swivel 41, seals 42 are mounted. On the tip side of the front cap 40, a front bush 43, which is a bearing member, is fitted. The sliding portion 51 of the shank rod 50 is in sliding contact with the inner diameter surfaces of the seals 42 and is supported by the inner diameter surface of the front bush 43 in a rotatable and slidable manner.

On the front end of the shank rod 50, the sleeve 60 is mounted with a threaded portion 53 of the shank rod 50 and a threaded portion 61 of the sleeve 60 screwed to each other. The sleeve 60 also has a threaded portion formed on the not-illustrated front side, and the rod 70 is screwed to the threaded portion.

The shank rod 50, by being struck by the hammering piston 21, transmits hammering energy to the rod 70 and the bit 80 via the sleeve 60 and, in conjunction therewith, transmits rotational driving force of the rotation mechanism to the rod 70 and the bit 80 as described above and thereby crushes bedrock, which is an object to be crushed.

The material of principal members constituting the rock drill 10 is alloy steel except that the material of the chuck 35 and the front bush 43 is copper alloy and the material of the swivel 41 is stainless steel. Because, among the members made of alloy steel, the hammering piston 21 and the shank rod 50, in particular, repeatedly collide with each other, nickel-chromium-molybdenum steel, which excels in high hardness and high wear resistance, is employed for the hammering piston 21 and the shank rod 50. Carburizing heat treatment is performed on the nickel-chromium-molybdenum steel.

While, among the drill tools DT, the shank rod 50 and the rod 70 are bearing-supported by the front bush 43 and a centralizer 106, respectively, progression of wear of the bearing members tends to be accelerated in association with the rock drill 10 having been provided with high output power.

When wear of the bearing members has progressed and backlash thereof has become large, bending stress acts on the drill tools DT due to thrust force of the feed mechanism 104. Thus, there is a possibility that breakage may occur at stress concentration sites, such as a threaded portion. As such, the drill tools DT are required to have bending rigidity in addition to hardness and wear resistance.

Accordingly, for the shank rod 50 of the present embodiment, alloy steel the constituent materials of which are composed of the following chemical components: 0.22 to 0.26 wt % of C, 0.15 to 0.35 wt % of Si, 0.55 to 0.80 wt % of Mn, 2.60 to 3.00 wt % of Ni, 1.00 to 1.50 wt % of Cr, 0.20 to 0.30 wt % of Mo, and Fe and inevitable impurities as the balance is used.

The shank rod 50 is produced by, when carburizing-quenching and tempering are performed on the material as heat treatment, performing the heat treatment with the quenching after carburizing performed by means of oil cooling with cold oil (oil cooling temperature is, for example, 60 to 80° C.) and tempering temperature set at 400 to 440° C.

Figure 9:
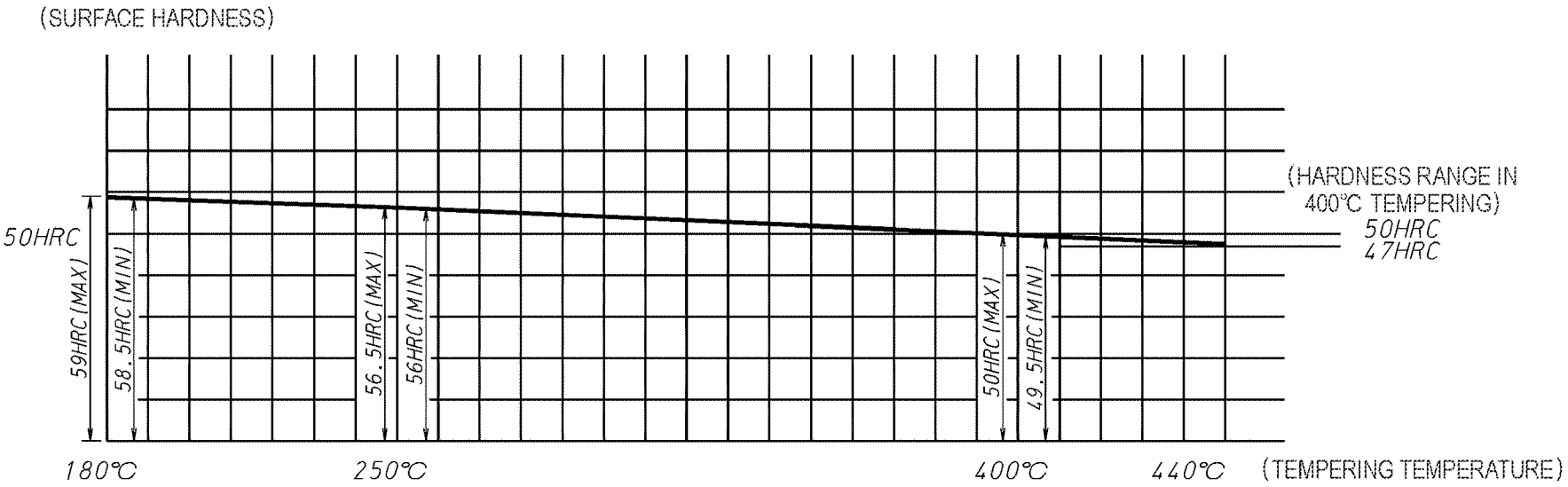
FIG. 9 is a graph illustrative of a relationship between surface hardness of a carburized layer on the surface of a shank rod and tempering temperature.

Because of this method, the shank rod 50 of the present embodiment has a carburized layer on the shank rod surface causing not only surface hardness (47 to 50 HRC, see FIG. 9) and wear resistance to be secured, but also the internal structure to be troostite and is thereby substantially improved in bending strength. As such, the shank rod 50 of the present embodiment is capable of coping with the rock drill 10 provided with high output power.

However, in the shank rod 50 of the present embodiment, while bending strength is substantially improved, hardness is slightly reduced instead. The inventors have found that sub-zero treatment and electroless nickel plating treatment are effective as a means for compensating for the reduction in hardness.

In particular, increasing the heating temperature to a tempering temperature of 400 to 440° C. after performing electroless nickel plating treatment enables the surface hardness to be raised higher than a surface hardness achievable by regular carburizing-quenching.

Note that the electroless nickel plating treatment enables corrosion resistance of not only the outer surface of the shank rod 50, such as the sliding portion 51, the outer-diameter square spline 52, and the threaded portion 53, but also the inside of the water hole 54 to be improved. As such, the shank rod 50 of the present embodiment is suitable for the rock drill 10 that uses water as flushing fluid.

Hereinafter, description will be made based on examples and comparative examples.

First Example

In a first example, using alloy steel (hereinafter, also referred to as "alloy steel for the present invention") the constituent materials of which are composed of the following chemical components: 0.22 to 0.26 wt % of C, 0.15 to 0.35 wt % of Si, 0.55 to 0.80 wt % of Mn, 2.60 to 3.00 wt % of Ni, 1.00 to 1.50 wt % of Cr, 0.20 to 0.30 wt % of Mo, and Fe and inevitable impurities as the balance, a ϕ40 mm×480 mm test piece, the size of which is close to the actual size of the shank rod, was prepared.

Figure 3:
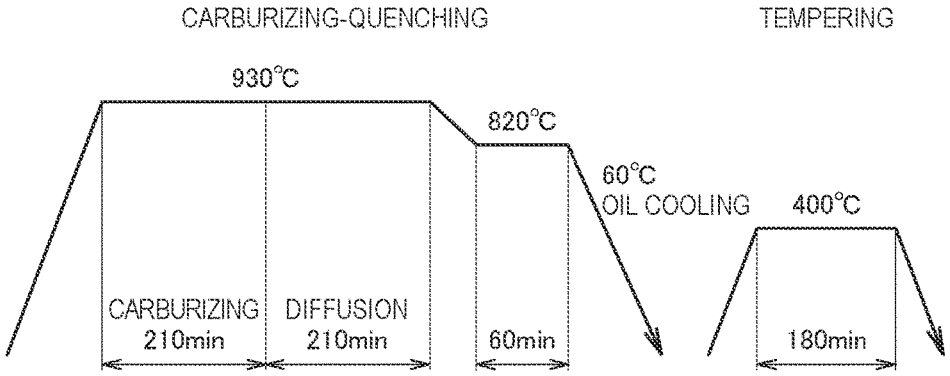
FIG. 3 is a process chart of surface treatment in a first example of the drill tool according to the present invention.

In the first example, heat treatment that is, as illustrated in FIG. 3, composed of a carburizing-quenching process including: temperature raising; carburizing at 930° C. for 210 min; diffusion at 930° C. for 210 min; heating at 820° C. for 60 min; and oil cooling with 60° C. cold oil in this order. Thereafter, a tempering process at 400° C. for 180 min was performed on the test piece.

Figure 5:
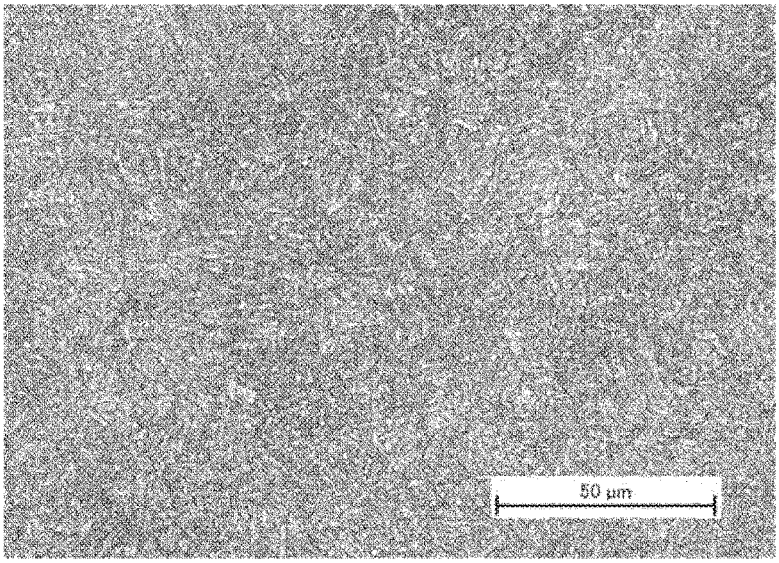
FIG. 5 is a microscope photograph of a troostite structure of the drill tool according to the present invention.

The structural state of the test piece in the first example was troostite, as illustrated in FIG. 5. The surface hardness and the core hardness of the test piece were 47.5 HRC and 41 HRC, respectively. The result of the bending test performed in accordance with JIS Z2248 (hereinafter, the same applies) was that the test piece, although bent 29.7 mm under a load of 155.0 kN, was not broken.

Figure 8:
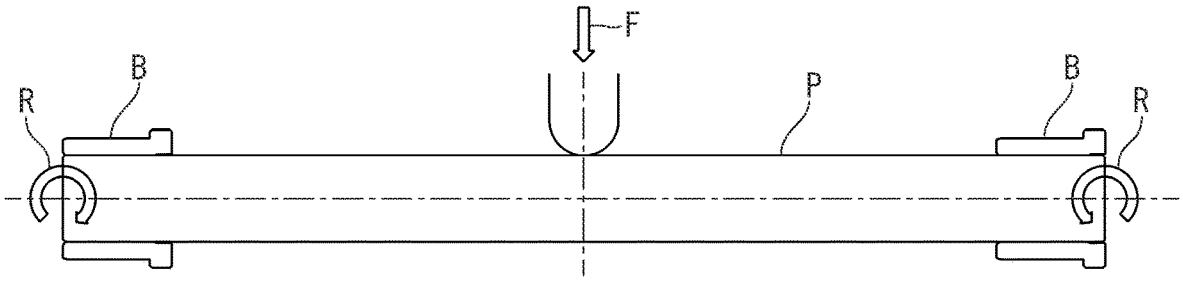
FIG. 8 is a schematic diagram descriptive of a test device used in a bending test.

The test device used in the bending test uses, as bushes B supporting both ends of a test piece P, bushes that are set to rotate following a bend of the test piece P when the middle of the test piece P is pressed, as illustrated in a schematic diagram in FIG. 8. Note that an arrow indicated by a sign F in FIG. 8 illustrates an image in which the middle of the test piece P is pressed. Arrows indicated by signs R in FIG. 8 illustrate an image in which the bushes B at both ends rotate following a bend.

Second Example

Figure 4:
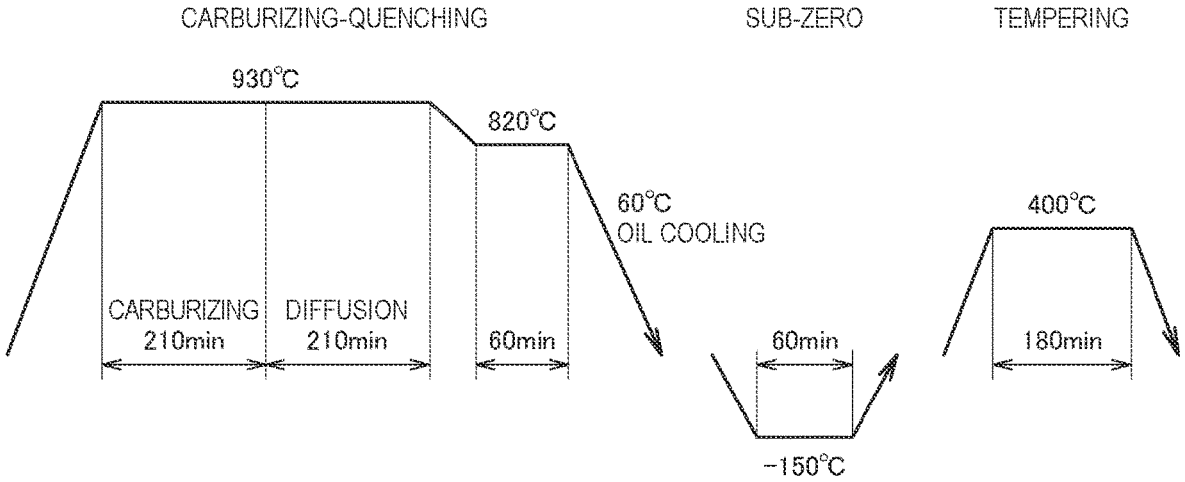
FIG. 4 is a process chart of surface treatment in a second example of the drill tool according to the present invention.

In a second example, a test piece made of the alloy steel for the present invention, which is similar to that in the first example, was prepared. In the second example, the carburizing-quenching process and the tempering process were performed on the test piece under the same conditions as those in the first example. In conjunction therewith, sub-zero treatment (at −150° C. for 60 min) was performed between the carburizing-quenching process and the tempering process, as illustrated in FIG. 4.

The structural state of the test piece in the second example was troostite and was densified more than that in the first example. The surface hardness and the core hardness of the test piece were 51 HRC and 43 HRC, respectively. The result of the bending test was that the test piece, although bent 28.0 mm under a load of 155.2 kN, was not broken.

Third Example

In a third example, a shank rod 50 was produced using the alloy steel for the present invention as a material. After heat treatment similar to that in the first example was performed on the shank rod 50, electroless nickel plating treatment was performed and a process of heating to 300° C. was further performed.

The structural state of the shank rod 50 in the third example was troostite. The surface hardness and the core hardness of the test piece were 64 HRC and 41 HRC, respectively. The bending test was not performed.

Figures 6A, 6B:
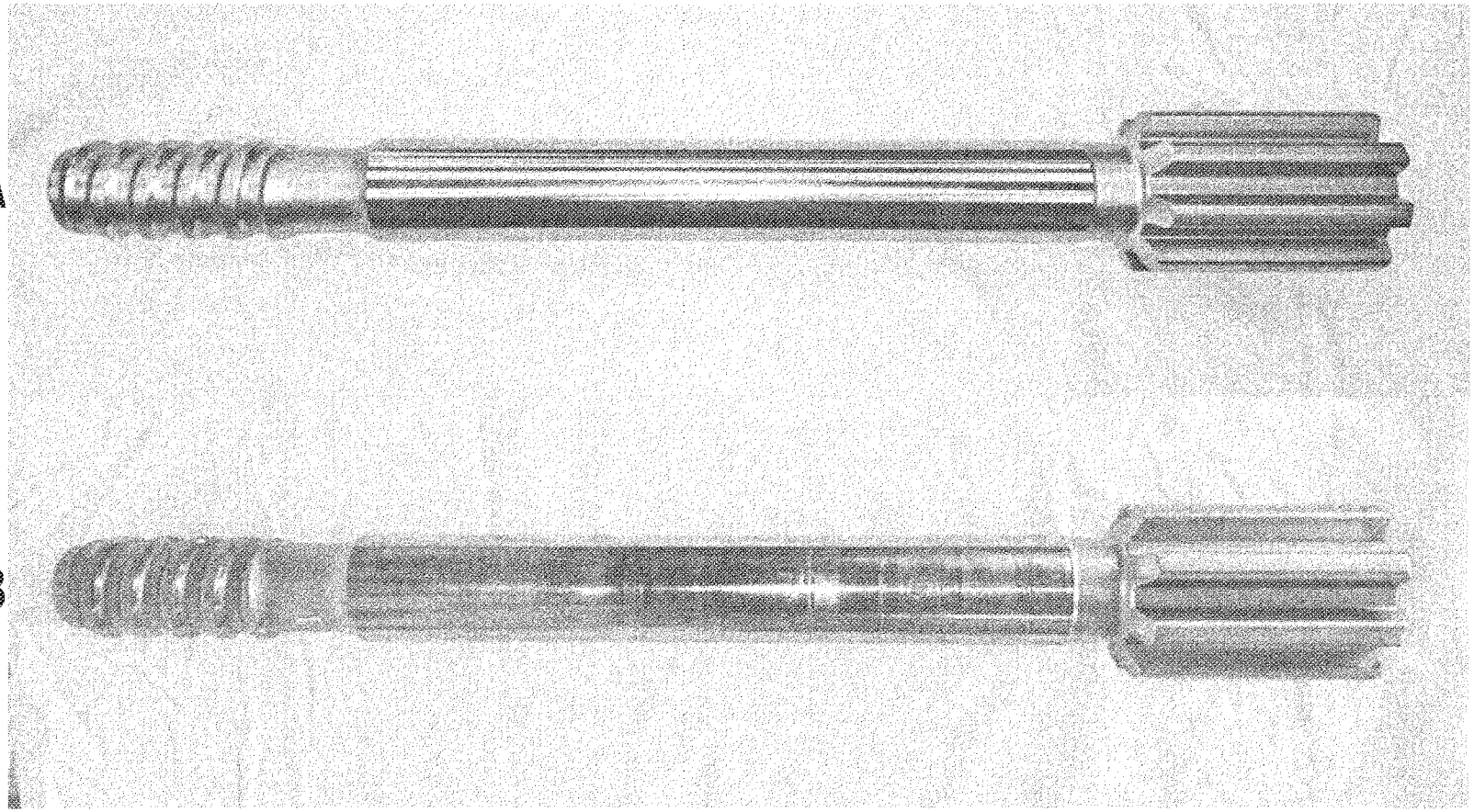

The shank rod 50 of the third example was incorporated into the above-described rock drill 10, and a durability test in which the rock drill 10 is operated with a pressure of 23.5 MPa for 30 min (regular working pressure is 17.5 MPa) was performed. As a result of the durability test, regarding the shank rod 50 of the third example, although a change in color was observed on the sliding portion, no damage was found. FIGS. 6A and 6B are photographs of the shank rod 50 of the third example before the durability test (FIG. 6A) and after the durability test (FIG. 6B).

First Comparative Example

Figure 10:
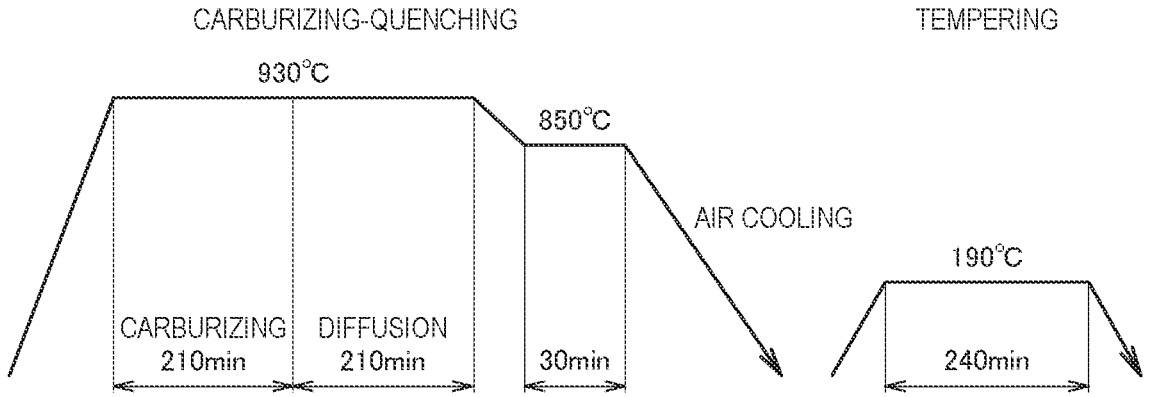
FIG. 10 is a process chart of surface treatment on a conventional drill tool.

In a first comparative example, a test piece made of the alloy steel for the present invention, which is similar to that in the first example, was prepared. On the test piece, heat treatment that is, as illustrated in FIG. 10, composed of a carburizing-quenching process including: temperature raising; carburizing at 930° C. for 210 min; diffusion at 930° C. for 210 min; heating at 850° C. for 30 min; and air cooling in this order. Thereafter, a tempering process at 190° C. for 240 min was performed.

Figure 11:
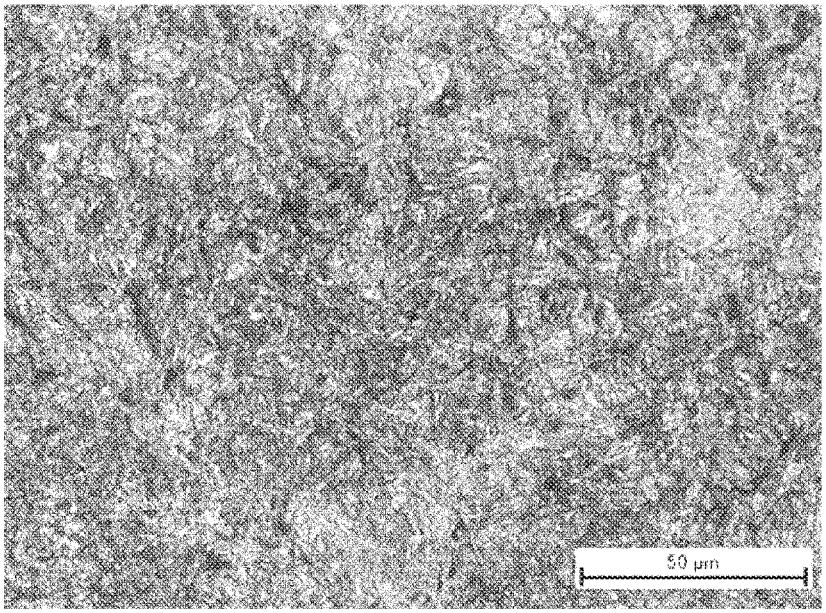
FIG. 11 is a microscope photograph of a martensite structure of the conventional drill tool.
Figure 12:
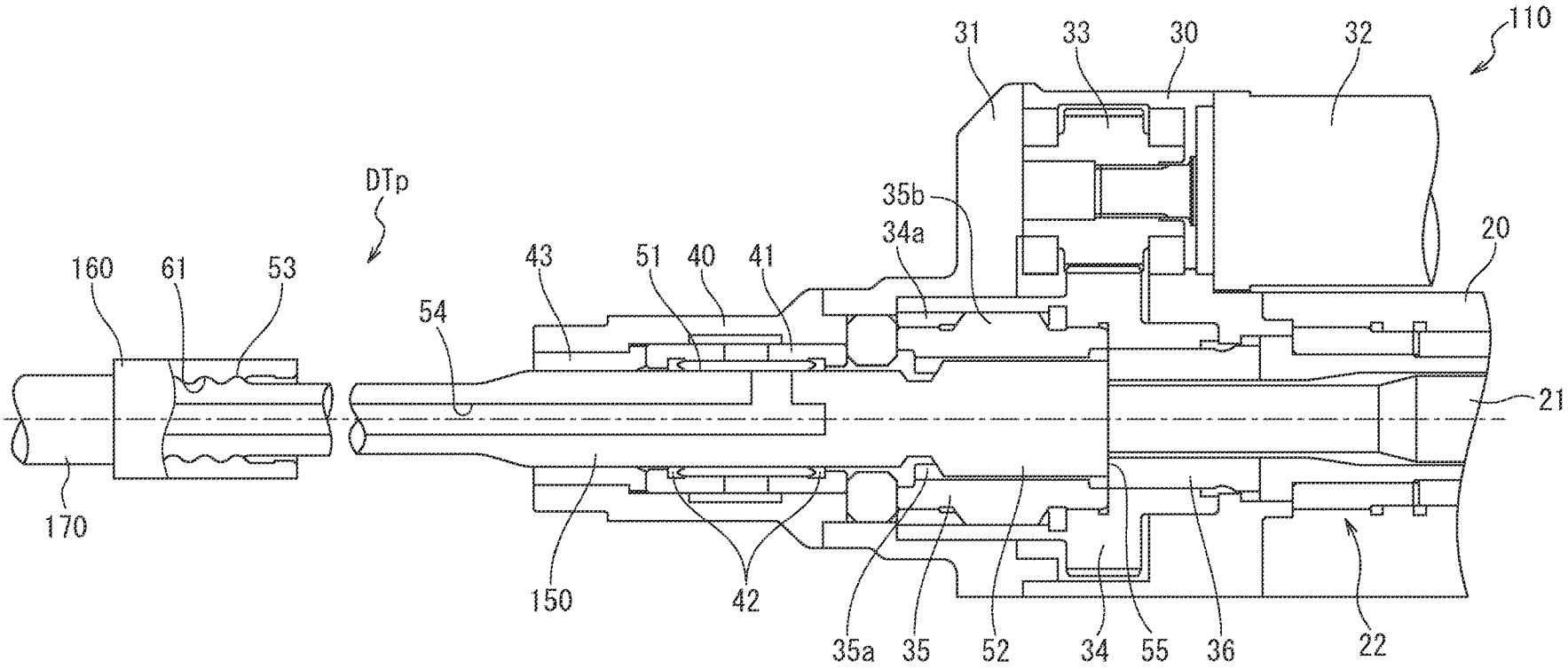
FIG. 12 is a schematic cross-sectional view illustrative of an internal structure of a conventional rock drill.

The structural state of the test piece in the first comparative example was martensite, as illustrated in FIG. 11. The surface hardness and the core hardness of the test piece were 58.5 HRC and 40 HRC, respectively. The result of the bending test was that the test piece was bent 8.4 mm under a load of 130.3 kN and was broken.

Second Comparative Example

In a second comparative example, a test piece made of the alloy steel for the present invention, which is similar to that in the first example, was prepared. On the test piece, heat treatment that is composed of a carburizing-quenching process including: temperature raising; carburizing at 930° C. for 210 min; diffusion at 930° C. for 210 min; heating at 850° C. for 30 min; and air cooling in this order. Thereafter, a tempering process at 250° C. for 240 min was performed.

The structural state of the test piece in the second comparative example was martensite. The surface hardness and the core hardness of the test piece were 56.5 HRC and 40 HRC, respectively. The result of the bending test was that the test piece was bent 8.5 mm under a load of 131.5 kN and was broken.

Third Comparative Example

In a third comparative example, a test piece made of the alloy steel for the present invention, which is similar to that in the first example, was prepared. On the test piece, heat treatment that is composed of a carburizing-quenching process including: temperature raising; carburizing at 930° C. for 210 min; diffusion at 930° C. for 210 min; heating at 820° C. for 60 min; and oil cooling with 60° C. cold oil in this order. Thereafter, a tempering process at 180° C. for 180 min was performed.

The structural state of the test piece in the third comparative example was martensite. The surface hardness and the core hardness of the test piece were 59 HRC and 43 HRC, respectively. The result of the bending test was that the test piece was bent 3.7 mm under a load of 114.3 kN and was broken.

Fourth Comparative Example

In a fourth comparative example, a test piece made of the alloy steel for the present invention, which is similar to that in the first example, was prepared. On the test piece, heat treatment that is composed of a carburizing-quenching process including: temperature raising; carburizing at 930° C. for 210 min; diffusion at 930° C. for 210 min; heating at 820° C. for 60 min; and oil cooling with 60° C. cold oil in this order. Thereafter, a tempering process at 250° C. for 180 min was performed.

The structural state of the test piece in the fourth comparative example was martensite. The surface hardness and the core hardness of the test piece were 56.5 HRC and 45 HRC, respectively. The result of the bending test was that the test piece was bent 4.0 mm under a load of 128.1 kN and was broken.

Heat treatment conditions and evaluation results of the first to third examples and the first to fourth comparative examples described above are collectively shown in Tables 1 and 2, respectively.

TABLE 1

| | Quenching | Tempering | Sub-zero | Plating |
|---|---|---|---|---|
| Example 1 | 60° C. oil cooling | 400° C. | None | None |
| Example 2 | 60° C. oil cooling | 400° C. | Done | None |
| Example 3 | 60° C. oil cooling | 400° C. | None | Done |
| Comparative example 1 | Air cooling | 190° C. | None | None |
| Comparative example 2 | Air cooling | 250° C. | None | None |
| Comparative example 3 | 60° C. oil cooling | 180° C. | None | None |
| Comparative example 4 | 60° C. oil cooling | 250° C. | None | None |

TABLE 2

| | Structural state | Hardness (surface) | Hardness (core) | Bending amount | Load |
|---|---|---|---|---|---|
| Example 1 | Troostite | 47.5 HRC | 41 HRC | 29.7 mm Not broken | 155.0 kN |
| Example 2 | Troostite Densified | 51 HRC | 43 HRC | 28.0 mm Not broken | 155.2 kN |
| Example 3 | Troostite | 64 HRC | 41 HRC | N/A | N/A |
| Comparative example 1 | Martensite | 58.5 HRC | 40 HRC | 8.4 mm Broken | 130.3 kN |
| Comparative example 2 | Martensite | 55.5 HRC | 40 HRC | 8.5 mm Broken | 131.5 kN |
| Comparative example 3 | Martensite | 58 HRC | 43 HRC | 3.7 mm Broken | 114.3 kN |
| Comparative example 4 | Martensite | 56 HRC | 45 HRC | 4.0 mm Broken | 128.1 kN |

Next, a variation of the drill tools DT will be described.

Figure 7:
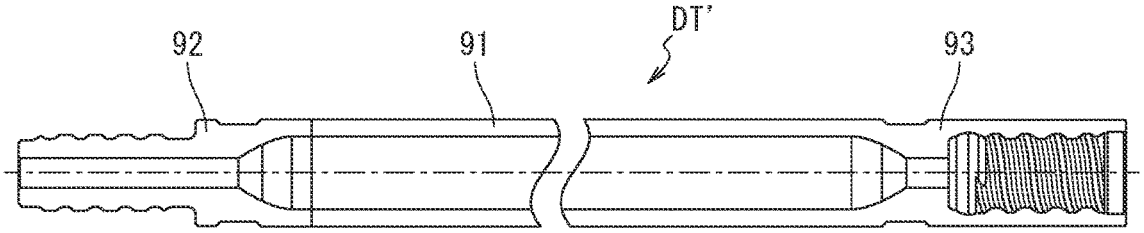
FIG. 7 is a schematic longitudinal cross-sectional view of a drill tube that is employed in place of a rod as a variation of the drill tool.

FIG. 7 is a longitudinal cross-sectional view of a drill tube 90, which is employed in place of the above-described rod 70, taken along the axis thereof, illustrated as a configuration of a drill tool DT' that is a variation of the drill tools DT.

As illustrated in FIG. 7, the drill tube 90 has a tube 91 that has a hollow cylindrical shape and is disposed at the middle and a male threaded portion 92 and a female threaded portion 93 that are joined to both ends of the tube 91.

The drill tube 90 is a drill tube that is produced by, with respect to only the male threaded portion 92 and the female threaded portion 93, employing the alloy steel for the present invention, which was described in the above-described first example, as a material and, in conjunction therewith, performing the heat treatment described in the first example. Note that the tube 91, the male threaded portion 92, and the female threaded portion 93 are integrated with one another by performing the heat treatment on the male threaded portion 92 and the female threaded portion 93 and, subsequently, friction welding the tube 91 with the male threaded portion 92 and the female threaded portion 93.

Since this production method causes the internal structure of the drill tube 90 to be troostite with respect to only the threaded portions at both ends, on which stress is likely to concentrate, the bending rigidity of the drill tube 90 is improved. As such, when the drill tools DT' including the drill tube 90 are used for the rock drill 10 provided with high output power, damage to the drill tools DT' is prevented or suppressed even when wear of bearing members has progressed and bending stress acts on the drill tools DT'.

As the embodiment and the examples and comparative examples of the present invention have been described above with reference to the drawings and the tables as appropriate, the present invention enables a drill tool capable of coping with a rock drill provided with high output power and a method for producing the drill tool to be provided.

Note that the drill tool for a rock drill according to the present invention is not limited to the above-described embodiments and examples, and it is apparent that, unless departing from the spirit and scope of the present invention, other various modifications and alterations to the respective constituent components are allowed to be made.

For example, regarding the rod 70, instead of applying the present invention to all regions as with the drill tube, after employing the alloy steel for the present invention as a material of and also performing the heat treatment according to the present invention on only a threaded portion, on which stress is likely to concentrate, a straight body portion at the middle and the threaded portion may be joined and thereby integrated with each other.

In addition, although a configuration example in which the threaded portion of the shank rod 50 is a male thread, the threaded portion of the sleeve is a female thread, and the threaded portion of the rod is a male thread is described, the present invention is not limited to the example and the male-female relationship is freely changeable. For example, one of the threaded portions of the rod 70 may be configured to be a female thread and the sleeve may be omitted.

A list of reference signs used in the drawing figures is shown below.

10 Rock drill
20 Cylinder
21 Hammering piston
22 Damper mechanism
30 Front head
31 Front cover
32 Motor
33 Driving gear
34 Chuck driver
**34*a*** Inner-diameter square spline
35 Chuck
**35*a*** Inner-diameter square spline
**35*b*** Outer-diameter square spline
36 Chuck driver bush
40 Front cap
41 Swivel body
42 Seal
43 Front bush
50 Shank rod
51 Sliding portion
52 Outer-diameter square spline
53 Threaded portion
54 Water hole
55 Rear end surface
60 Sleeve
61 Threaded portion
70 Rod
80 Bit
90 Drill tube
91 Tube
92 Male threaded portion
93 Female threaded portion
100 Crawler drill

101 Traveling carriage
102 Boom
103 Guide shell
104 Feed mechanism
105 Carriage
106 Centralizer
DT, DT' Drill tool

The invention claimed is:

1. A production method for a drill tool, the production method being a method for producing a drill tool used for a rock drill, wherein the drill tool is produced by employing, as a material of the drill tool, alloy steel composed of following chemical components:

0.22 to 0.26 wt % of C,
0.15 to 0.35 wt % of Si,
0.55 to 0.80 wt % of Mn,
2.60 to 3.00 wt % of Ni,
1.00 to 1.50 wt % of Cr,
0.20 to 0.30 wt % of Mo, and
Fe and inevitable impurities as a balance;

the drill tool is produced by subjecting the material to a heat treatment step that includes a carburizing-quenching step and a tempering step;

the carburizing-quenching step is performed by means of oil cooling with cold oil after carburizing, and a temperature of the cold oil is set at 60° C. to 80° C.; and a tempering temperature of the tempering step is set at 400° C. to 440° C.

2. The production method for the drill tool according to claim 1, wherein sub-zero treatment is performed between the carburizing-quenching and the tempering.

3. The production method for the drill tool according to claim 2, wherein electroless nickel plating treatment is performed after the tempering and, subsequently, heating is performed at a temperature equal to or less than the tempering temperature.

4. The production method for the drill tool according to claim 1, wherein electroless nickel plating treatment is performed after the tempering step and, subsequently, heating is performed at a temperature equal to or less than the tempering temperature.

* * * * *